United States Patent [19]

Mynard et al.

[11] 3,989,558

[45] Nov. 2, 1976

[54] COATING AND DIFFUSION PROCESS FOR IMPROVING THE LIFE OF COBALT-BONDED SINTERED CARBIDE TOOLS

[75] Inventors: Brian Arthur Mynard, Bromsgrove; Bryan Jones; Victor Allen Tracey, both of Solihull; Walter Betteridge, Kent, all of England

[73] Assignee: The International Nickel Company, Inc., New York, N.Y.

[22] Filed: Dec. 26, 1973

[21] Appl. No.: 428,107

Related U.S. Application Data

[63] Continuation-in-part of Ser. No. 256,889, May 25, 1972, Pat. No. 3,785,783.

[52] U.S. Cl. ..... 148/126; 75/200; 75/208 R; 75/204

[51] Int. Cl.[2] ..... B27F 3/00

[58] Field of Search ..... 75/200, 204, 208; 148/126

[56] References Cited

UNITED STATES PATENTS

| | | | |
|---|---|---|---|
| 2,039,822 | 5/1936 | McKenna | 29/182.8 |
| 2,672,426 | 3/1954 | Grubel et al. | 29/182.8 |
| 3,171,192 | 3/1965 | Ortner et al. | 75/203 |
| 3,264,222 | 8/1966 | Carpenter et al. | 75/203 |

FOREIGN PATENTS OR APPLICATIONS

| | | |
|---|---|---|
| 2,011,082 | 9/1970 | Germany |
| 1,309,634 | 3/1973 | United Kingdom |

*Primary Examiner*—Brooks H. Hunt
*Attorney, Agent, or Firm*—Francis J. Mulligan, Jr.; Ewan C. MacQueen

[57] ABSTRACT

A process for improving the characteristics of cobalt-bonded sintered carbide articles comprising coating the surface of the article with metal of the group of osmium and ruthenium and diffusing the osmium or ruthenium into the carbide body.

4 Claims, No Drawings

COATING AND DIFFUSION PROCESS FOR IMPROVING THE LIFE OF COBALT-BONDED SINTERED CARBIDE TOOLS

The present application is a continuation-in-part of U.S. application Ser. No. 256,889 filed on May 25, 1972, now U.S. Pat. No. 3,785,783.

The present invention is concerned with articles which present one or more working surfaces subject to wear in use. As is well known, the most common articles of this kind are cutting tools having at least one cutting edge between rake and flank faces, the actual cutting edge and parts of these faces being working surfaces subjected to considerable wear, which limits the cutting life. The whole of the tool may be made of sintered hard metal consisting essentially of a metal carbide and a metal binder of the iron group, but usually only the tip of the tool is made of hard metal and is carried by a steel or other support.

Other articles which are subjected to wear and become heated in use are drills, wire-drawing dies, powder-compacting and metal-forming dies and some journal bearings, the bores and surfaces of which become worn in use.

As is well known, sintered carbide is a product of powder metallurgy made of finely divided, hard particles of a carbide of a refractory metal sintered with one or more metals of the iron group. The hard particles are, most advantageously, tungsten carbide, usually in combination with lesser amounts of other carbides. The additional carbides are those of titanium and tantalum with some occasional specialized use being made of the carbides of niobium, molybdenum, vanadium, chromium, zirconium and hafnium. For most commercial purposes, the binder metal is cobalt.

The carbides are present as individual grains and also as a finely dispersed network resulting from the precipitation during cooling of carbide dissolved in the cobalt during sintering. Table I sets forth in percent by weight the composition of certain types of carbide compositions to which the present invention is applicable.

TABLE 1

| Carbide Group | %Co | %TaC+ TiC | %WC |
|---|---|---|---|
| 1 | 2.5 – 6.5 | 0 – 3 | Bal. |
| 2 | 6.5 – 15 | 0 – 2 | Bal. |
| 3 | 15 – 30 | 0 – 5 | Bal. |
| 4* | 3 – 7 | 20 – 42 | Bal. |
| 5* | 7 – 10 | 10 – 22 | Bal. |
| 6* | 1 – 12 | 8 – 15 | Bal. |
| 7** | 4.5 – 8 | 16 – 25 | Bal. |
| 8** | 8 – 10 | 12 – 20 | Bal. |
| 9*** | 5.5 – 16 | 18 – 30 | Bal. |

* Added carbide is predominantly TiC
** Added carbide is predominantly TaC
***Added carbide is exclusively TaC The carbide groups set forth in Table I are generally used for cutting purposes for various types of metal. The carbides of group 3 are especially useful for high-impact die applications and the carbides of group 9 are specifically applicable for wear-resistant applications particularly involving heat. One common hard metal used for cutting tips consists of 94% tungsten carbide and 6% cobalt, and another of 82% tungsten carbide, 13% titanium carbide and 5% cobalt, or, more precisely, 82.5% tungsten carbide, 13% titanium carbide and 4.5% cobalt, known to the trade as grades C-1 and C-6 respectively.

It is an object of the present invention to provide a novel process for providing an improved surface on carbide and other cutting tools.

Other objects and advantages will become apparent from the following description.

Generally speaking, the present invention contemplates coating a sintered body of carbide and cobalt with ruthenium or osmium or both and heat-treating the coated body to cause partial diffusion of the coating into the cobalt. The heat treatment is carried out so that in all volumes of the sintered body containing osmium and/or ruthenium the cobalt content exceeds the precious metal content. One produces by means of this process sinterbonded carbide articles such as cutting tools or the like which are substantially improved compared to the untreated article. The coating can be formed in any convenient way, for example, by electrodeposition, plasma-spraying or vapor deposition; or by applying a slurry of powder and sintering; or by applying liquid-bright (a ruthenium-bearing liquid) and subsequently decomposing this to metal by heating. The coating can also be formed while the article is being made in that it may be applied for example by plasma-spraying to a compact of the carbide and binder metal before this is sintered, or that a layer of ruthenium or osmium may be put on a compact and compacted again before the compact is sintered or by means of a slurry on to a pre-sintered compact.

The coating can be very thin, say 2 or 3 microns thick or less, but the thickness is in part dependent on the way in which the coating is produced. When it is produced electrolytically it is found that the quality tends to be inconsistent when the thickness is greater than 6 microns. However, so far as improvement in life is concerned, coatings of equal quality from 2 to 30 microns in thickness gave substantially the same improvement and the preferred thickness is from 2 to 10 microns. Coatings applied by plasma spraying are inevitably thicker by nature of the process and may be, for example, as great as 125 microns thick.

If the coating is formed by the application of a 'liquid-bright' (a ruthenium-bearing liquid produced by the reaction of a ruthenium halide with an ether), a single application followed by drying and heating at say 600° C. yields a coating about 0.5 microns thick, and it is desirable to repeat the process several times in order to produce a thicker final coating e.g., at least about 1 micron thick.

Most electrolytic baths from which ruthenium or osmium can be deposited are so acidic as to attack the binder in the hard metal, and when such a bath is used a flash coating of a resistant metal, which may be gold or palladium, should first be applied.

The heat-treatment to cause partial diffusion of the ruthenium or osmium into the hard metal should not be such as to cause excessive migration of the cobalt or other binder metal out of the hard metal or result in substantial coarsening of the carbide grain. The temperature of the heat treatment is in the range 1250° to 1400° C, and the duration is broadly inversely proportional to the temperature. At temperatures up to 1300° C. the diffusion is slow, and when the temperature is raised above 1350° C. degradation of the carbide occurs with loss of cutting properties. The durations at different temperatures are as follows:

| Temperature | Duration range in hours | Optimum duration in hours |
|---|---|---|
| 1400° C | <1 | ½ |
| 1375° C | <2 | 1 |
| 1350° C | 1 to 4 | 2 |
| 1335° C | 1 to 5 | 2 |
| 1325° C | 1 to 24 | 6 |
| 1300° C | 1 to 24 | 24 |
| 1250° C | 6 to 30 | >24 |

The temperature is preferably from 1335° to 1350° C, and the duration from 1 to 2 hours. It is desirable to cool slowly from temperature (taking about 1 hour to cool) to avoid embrittlement of the metal matrix. In cases where the osmium and/or ruthenium is deposited on an unsintered body, the coated body is repressed and then sintered, the diffusion will occur simultaneously with sintering which is carried out at a temperature somewhat higher than the temperatures set forth in the foregoing table.

We believe that the reason for the improvement provided by the process of the invention is an increase in the transition temperature of cobalt as the result of alloying it with ruthenium or osmium. Pure cobalt has a closepacked hexagonal structure which gives the hard metal low friction characteristics, and this changes to a facecentred cubic structure at about 400° C, with loss of the desirable low friction characteristics. Typically a cutting edge attains a temperature of about 1000° C. As the cobalt becomes increasingly rich in ruthenium or osmium the transition temperature rises, and is 1100° C in an alloy containing 70% cobalt and 30% ruthenium. Thus by raising the transition temperature the hexagonal structure is at least partly maintained despite the heat developed in use, and the working life is prolonged or the cutting speed can be higher. Support for this theory is to be found in the fact that the other metals of the platinum group, which do not have the same effect on the transition temperature of cobalt, do not give improvement similar to that produced by ruthenium or osmium. Further ruthenium and osmium in proper amounts tend to increase the high temperature strength of the cobalt binder. It is important that the coated and heat treated surface be substantially devoid of binder (cobalt plus osmium and/or ruthenium) containing greater than about 50% by weight total osmium and ruthenium. It has been demonstrated in an application filed concurrently herewith that carbide tools made with binder containing 60% by weight ruthenium balance cobalt do not show improvement as compared to tools bonded with cobalt alone. The same is true for tools produced by the coating and diffusion process as defined in the present claims.

It has been found desirable to ensure that the proportion of ruthenium to cobalt by weight in the binder at the working surface or surfaces is at least 1:6 though even a lesser amount of ruthenium alloyed with the cobalt gives some improvement. Normally the proportion is no more than 1:1.5 but may be as high as 1:1.

The proportion of osmium to cobalt is preferably at least 1:4 and may be as high as 1:1.

The invention is primarily useful in prolonging the life of cutting tips, and numerous test have been made on tips of the hard metal composed of 82.5% tungsten carbide, 13% titanium carbide and 4.5% cobalt. In these tests the conditions were severe, the tips being used to cut bars of EN30B steel (an alloy steel containing 0.3% carbon, 4% nickel, 1.25% chromium and 0.3% molybdenum) hardened and tempered to 500 Hv. The majority of the tests were carried out without cutting lubricant and coolant. The angle of approach of the tip to the work was 75°, the cut being made by one edge of the tip. The feed was 0.3 mm/rev. and the depth of cut was 1.3 mm. The life was determined when the tool tip broke off or 0.4 mm. average flank wear was observed or 0.8 mm localized flank wear was observed or the tip was observed to be no longer making a cut to a given diameter.

EXAMPLE 1

The tips were coated electrolytically with ruthenium in an aqueous electrolyte containing 30 g/l$(NH_4)_3[Ru_2NCl_8(H_2O)_2]$ and 10 g/l ammonium sulphamate, at a pH adjusted to 1.5 by the addition of sulphamic acid, the temperature of the electrolyte being 70° C. and the current density from 1 to 2 amp/dm$^2$. Prior to ruthenium plating the hard metal was given an initial flash coating of gold in an alkaline gold cyanide bath to avoid attack of the cobalt by the acid electrolyte. Ruthenium coatings of different thicknesses were produced and the coated tips were heat-treated at 1325° C. for 2 hours. Tips having coatings 6 microns and 10 microns thick had lives nine times as long as those of uncoated commercial tips, when the machining speed was 92 meters per minute.

EXAMPLE 2

The tips were electrolytically coated with osmium in an aqueous electrolyte containing 10 g/l potassium hexachloro-osmate, 15 g/l potassium chloride and 60 g/l potassium hydrogen sulfate, adjusted into the pH range of 1.2 to 1.5 by potassium hydroxide. The temperature of the electrolyte was 70° C, the cathode current density from 1 to 2 amps/dm$^2$ and the anode current density less than 0.5 amp/dm$^2$. This electrolyte also attacks hard metal, so all the tips were initially flash-coated with gold. The coated tips were heat-treated as in Example 1. The improvement in life given by an osmium coating 3 microns thick after heat-treatment was greater than 7 times those of the uncoated tips when machining at 67 m/min.

EXAMPLE 3

The tips were coated as in Example 2 in a mixed chloro-osmate /chloro-ruthenate electrolyte to give a coating of 3.5 $\mu$m of an alloy composed of 50% ruthenium and 50% osmium. After heat-treatment for 2 hours, 1325° C, the cutting life was 10 times greater than that of the uncoated tips when machining at 49 m/min.

EXAMPLE 4

The tips were coated with ruthenium to a thickness of about 125 microns by plasma-spraying ruthenium powder of particle size from 50 to 150 microns through a standard plasma-spray gun. After heat treatment for 2 hours at 1325° C, an improvement of 9 times in the life was obtained when machining at 64 m/min.

EXAMPLE 5

The tips were painted with ruthenium liquid bright, dried in air and fired in air at 600° C, and the process was repeated four times to build up the thickness to 1.5 microns. The coated tips were heat-treated at 1325° C for 2 hours. An increase in life of 6 times was obtained on machining at 49 m/min.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process of improving an article consisting essentially of metal carbide and a cobalt binder, and presenting one or more working surfaces subjected to wear in use, which comprises coating at least the working surface or surfaces of the article either prior to or subsequent to sintering with metal from the group of ruthenium and osmium and mixtures and alloys thereof, and causing diffusion between said coating metal and the cobalt to provide a sintered article having a surface layer containing less than 50% by weight of osmium and ruthenium based upon total of cobalt, osmium and ruthenium.

2. A process as in claim 1 wherein the osmium or ruthenium is coated on a sintered compact and the coated sintered compact is heated for a period of time that is dependent upon the temperature in accordance with the following table:

| Temperature | Duration in hours |
|---|---|
| 1400° C | <1 |
| 1375° C | <2 |
| 1350° C | 1 to 4 |
| 1335° C | 1 to 5 |
| 1325° C | 1 to 24 |
| 1300° C | 1 to 24 |
| 1250° C | 6 to 30 |

3. A process as in claim 2 in which the temperature is from 1335° to 1350° C. and the duration from 1 to 2 hours.

4. A process as in claim 2 in which the coating is applied electrolytically and is from 2 to 10 microns thick.

* * * * *